United States Patent [19]

Busch

[11] Patent Number: 4,648,848

[45] Date of Patent: Mar. 10, 1987

[54] SPAR BUOY FLUID TRANSFER SYSTEM

[75] Inventor: Roger A. Busch, Cypress, Tex.

[73] Assignee: Fluor Corporation, Irvine, Calif.

[21] Appl. No.: 796,989

[22] Filed: Nov. 12, 1985

[51] Int. Cl.[4] ..... B63B 21/00

[52] U.S. Cl. ..... 441/5; 114/230; 441/3

[58] Field of Search ..... 114/230; 441/3-5; 166/352, 359, 367

[56] References Cited

U.S. PATENT DOCUMENTS

| | | | |
|---|---|---|---|
| 3,525,312 | 8/1970 | Knapp | 441/4 |
| 3,774,562 | 11/1973 | Dean, III | 441/3 |
| 4,305,341 | 12/1981 | Stafford | 114/230 |
| 4,448,266 | 5/1984 | Potts | 166/357 |
| 4,490,121 | 12/1984 | Coppens et al. | 441/5 |

FOREIGN PATENT DOCUMENTS

| | | | |
|---|---|---|---|
| 8303279 | 4/1985 | Netherlands | 114/230 |

*Primary Examiner*—Galen Barefoot
*Assistant Examiner*—Edwin L. Swinehart
*Attorney, Agent, or Firm*—Poms, Smith, Lande & Rose

[57] ABSTRACT

A single point spar buoy mooring apparatus adapted to freely float in vertical position and readily attachable to a vessel, said apparatus including an outer rotatable cylinder and a superstructure supported therefrom, an inner nonrotatable cylinder coaxially within the outer cylinder and connected by mooring lines to anchors on the sea floor, a riser system including multiple riser lines extending from subsea wells through the inner cylinder to the top thereof, fluid transfer lines extending from the superstructure to the vessel, each riser line being connected to an associated transfer line and a turntable rotatable on the superstructure and connected with each riser line, said turntable being locked and held against rotation relative to said superstructure whereby turning of the vessel about the axis of the apparatus imparts a twist to said plurality of riser lines, said turntable being unlockable relative to the superstructure and rotatable to return the turntable to a reference position relative to the superstructure for untwisting said multiple risers without movement of the vessel about the axis of the spar buoy apparatus. A spar buoy apparatus and method permitting rotation of a vessel about the axis of the apparatus while preserving individual well fluid paths from multiple subsea wells.

14 Claims, 7 Drawing Figures

SPAR BUOY FLUID TRANSFER SYSTEM

BACKGROUND OF THE INVENTION

In the production of oil from subsea oil fields, it is often necessary to use multiple wells. Some wells produce oil; others are used for gas or water injection to increase a field production rates. Some wells require workover to remove deposits while the balance of the field continues to flow and other wells may require testing to verify the benefit of production enhancement measures. It is therefore preferable to maintain flow path continuity from each well head to the production equipment and thus avoid mixing of fluid from multiple wells.

In present production systems for offshore oil production utilizing floating tankers or vessels, flexible piping and swivels are used to allow the vessel to rotate with the wind direction. Such rotation requirement places severe restraints on customary oil well activities necessary for oil production. Such prior proposed systems have included a fluid swivel having up to six independent flow paths passing therethrough, the swivel being attached to the vessel bow. An example of such a system is described in U.S. Pat. No. 4,254,523.

Another present system allows production from greater than six wells by utilizing undersea manifolds to group production from such multiple wells in up to six flow paths. This method may allow oil production from twenty or more wells, but the individual flow path from each well head to production equipment is lost by mixing the oils streams in the undersea manifold. Costs of fabrication and expense of maintenance of such an undersea manifold system is a disadvantage to this system.

Another prior proposed system for transporting production fluid to a single point moored vessel includes the use of a turret connected directly to the vessel or a single point mooring buoy connected to the vessel with an articulated yoke mechanism. In such instances, a multiple passage fluid swivel is utilized or a piping manifold is required in the mooring structure. An example of such a turret with a manifold system is shown in U.S. Pat. No. 3,525,312. Where a large number of subsea wells are to be produced, tested and remotely controlled from a floating tank or vessel, the prior proposed use of a fluid swivel and/or manifold becomes very complicated, heavy, expensive and is subject to high maintenance costs.

A prior proposed system for transferring production fluids to a floating vessel and utilizing flexible hose or riser lines is described in U.S. Pat. No. 3,366,088. Flow lines from a plurality of subsea wells are connected to an anchor means, the flow lines being combined at the anchor means for transfer of fluid to a limited number of flexible riser lines and thence to a float where the lines may be connected to tankers brought alongside the float. As the float weathervanes about the anchor, the plurality of flexible lines twist. Untwisting of the lines is accomplished by turning the vessel about the anchor point in the opposite direction to the twist by using tugs to maneuver the vessel about its anchor point.

SUMMARY OF THE INVENTION

This invention relates to a novel single point spar buoy apparatus for use in the transfer of fluids in the production of oil from multiple subsea wells.

A primary object of the present invention is to provide such a spar buoy apparatus in which the continuity of separate flow paths of such production fluids is maintained from each well head to production equipment on a vessel to which the spar buoy apparatus is attached.

Another primary object of the present invention is to provide a spar buoy apparatus which is releasably attachable to a vessel and which allows rotation of the vessel relative to a multiple riser system associated with the spar buoy apparatus while keeping separate individual flow paths for the production fluid from each subsea well.

Another object of the present invention is to provide a single point spar buoy mooring apparatus in which flexible riser hose lines extending from the subsea installation to the spar buoy apparatus are permitted to twist during movement of a vessel around the axis of the spar buoy apparatus, said spar buoy apparatus including means for untwisting said riser lines without moving of the vessel.

A specific object of the invention is to provide a spar buoy mooring apparatus attachable to the bow of the vessel wherein flexible multiple riser lines are connected to fluid transfer lines to the vessel through a rotatable turntable which in locked condition causes the upper ends of the riser lines to turn with the vessel as it weathervanes due to wind, weather and wave conditions and wherein, in unlocked condition, the turntable means may return the twisted riser lines to untwisted relation without movement of the vessel relative to its anchor means. The invention contemplates that the connection between the transfer lines and the riser lines at the lockable turntable include block valves and quick release means for each riser line so that in the event excessive vessel rotation is anticipated, the quick release means may be opened and the turntable unlocked to permit the vessel to turn relative to the upper end of the riser lines without further twisting of the lines.

A further object of the present invention is to provide motor means to drive the turntable in rotation to facilitate untwisting of flexible riser lines.

A still further object of the present invention is to provide a spar buoy apparatus as described above in which turn indicator means are provided on the apparatus to record the number of turns of the vessel about the axis of the spar buoy apparatus so that the twist in the flexible multiple riser lines may be untwisted in the same amount of untwisting turns as the number of twisting turns.

A still further object of the present invention is to provide a spar buoy apparatus in which releasable clamp means are provided for readily attaching the spar buoy apparatus to the bow of a vessel.

A still further object of the present invention is to provide a spar buoy apparatus as above described which may be readily ballasted into submerged condition separate from the vessel to avoid ice floes or other environmental conditions.

Another advantage of the present invention is that the spar buoy apparatus is readily detachable from the bow of a vessel, the bow of the vessel being unmodified except for structural members which comprise part of the clamping means for the spar buoy apparatus.

Other objects and advantages of the present invention will be readily apparent from the following description of the drawings in which an exemplary embodiment of the invention is shown.

IN THE DRAWINGS

FIG. 2 is an elevational view of the spar buoy apparatus separated from the vessel and in a submerged position below the water surface at a depth to avoid interference with ice flows and the like.

DETAILED DESCRIPTION OF A PREFERRED EMBODIMENT OF THE INVENTION

Figure 1:
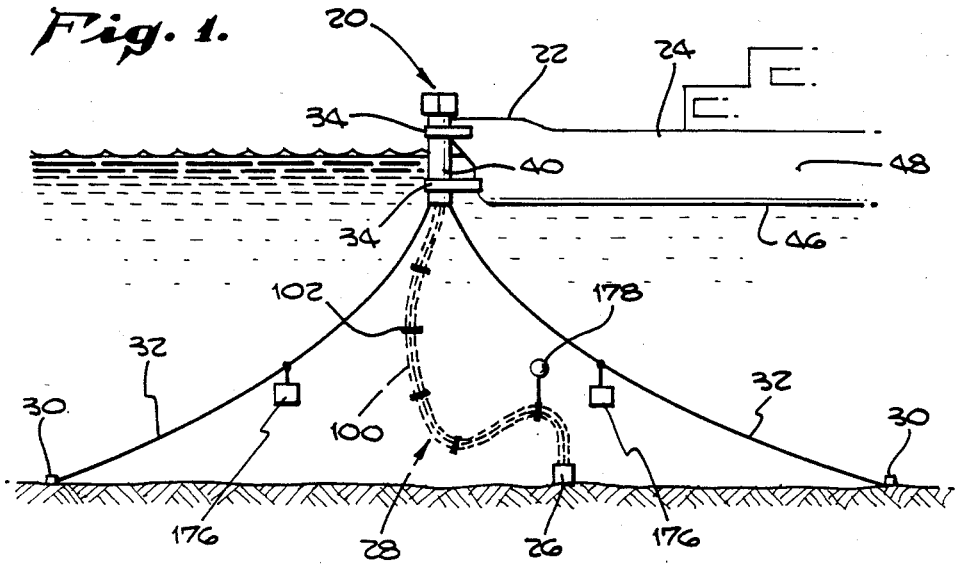
FIG. 1 is an elevational view showing a single point spar buoy apparatus embodying this invention attached to the bow end of a vessel and schematically showing anchoring of the spar buoy apparatus and its connection to a subsea well installation by flexible hose or risers.

In FIG. 1 a spar buoy apparatus embodying this invention is generally indicated at 20 and is shown attached to the bow end 22 of a vessel 24. Vessel 24 receives production fluids and other fluids from subsea installation 26 from which such fluids are conveyed by a riser system 28 which in this example includes a plurality of flexible hoses or lines. The vessel 24 may store the fluids received from the subsea installation 26, may process certain of said fluids, and may transfer such fluids to another vessel for further transport of the fluids to a selected destination.

The vessel 24 is anchored to the sea floor through a suitable system of spaced anchors 30 connected by catenary mooring lines 32 to the spar buoy apparatus 20. The apparatus 20 is fixedly held at the bow end of vessel 24 by spaced releaseable clamp means 34 as described more fully hereafter.

Apparatus 20 comprises a spar buoy means 40 including an elongated vertically positioned outer cylindrical member 42 having a length such that its bottom end 44 terminates at or below the bottom 46 of the hull 48 of vessel 24. Concentrically supported within outer cylinder 42 is an inner cylinder 50 having a length approximately that of the outer cylinder 42 and having a top out-turned flange 52 extending over a top annular flange 54 of the outer cylinder. The outer cylinder 42 and inner cylinder 50 are rotatable relative to each other and for this purpose spaced bearing means 56, 58, and 60 are provided between the adjacent cylindrical portions of said cylinders 42 and 50. A bearing means 62 is also provided between the out turned flanges 52 and 54.

Mooring lines 32 from the anchors 30 enter hawse pipes 64 provided at the outer periphery of inner cylinder 50. Upper ends of mooring lines 32 are secured by suitable means to upper ends of hawse pipes 64 as shown at 66 and 68. The arrangement of mooring lines 32 and anchors 30 of which only two of each are shown together with riser system 28, holds inner cylinder 50 against rotation. The rotatable mounting of outer cylinder 42 with respect to inner cylinder 50 permits vessel 24 to maintain its bow into the wind and permits weathervaning of the vessel about the axis of the cylinders through 360 degrees and more.

Figures 3, 7:
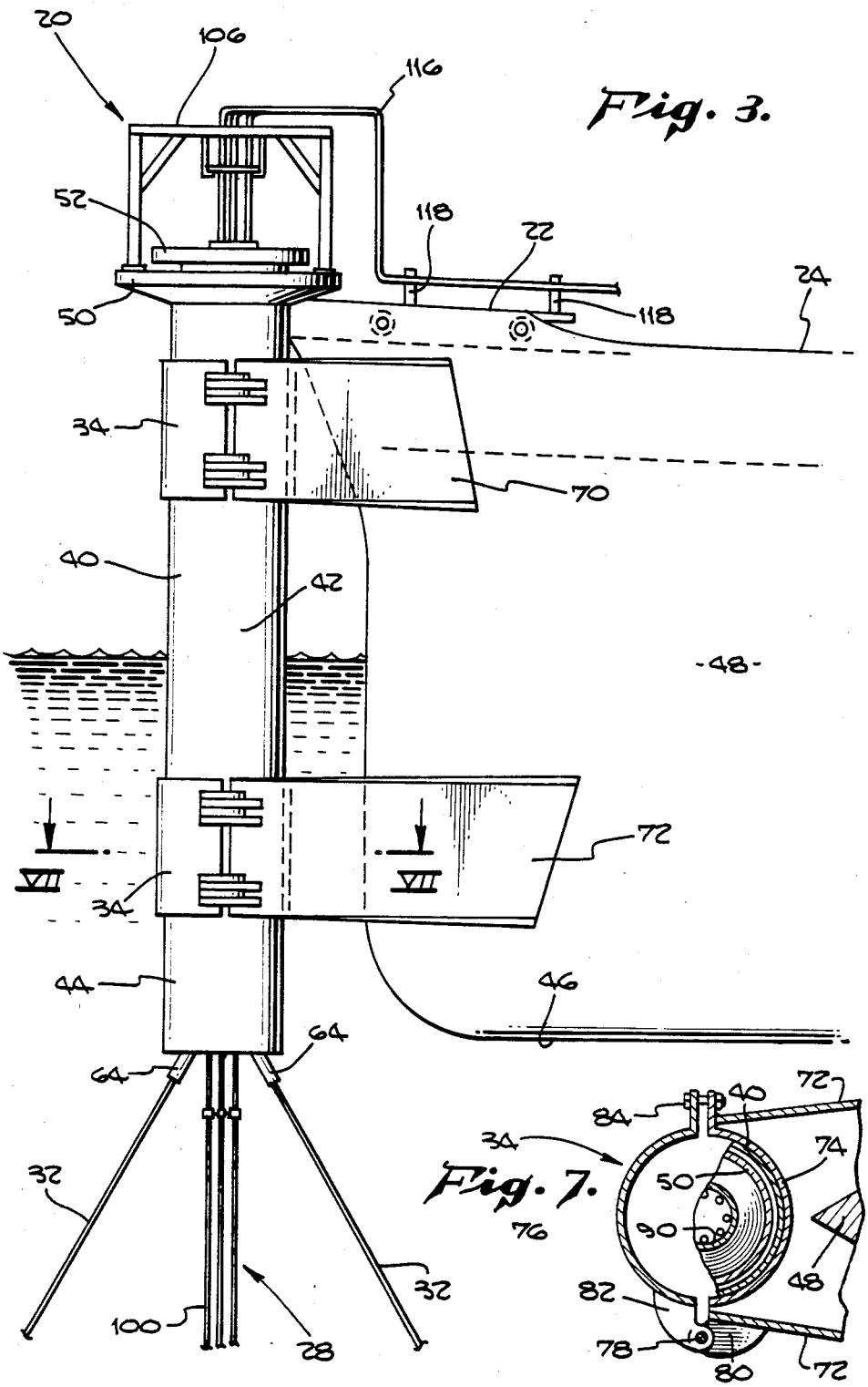
FIG. 3 is an enlarged view of the spar buoy apparatus shown in FIG. 1 attached to the bow of a vessel.
FIG. 7 is a fragmentary sectional view of clamping means for securing the apparatus to the bow of the vessel taken in the plane indicated by line VII—VII of FIG. 3.

Clamp means 34 for securing the vessel and the spar buoy apparatus in fixed relation include an upper set of forwardly projecting structural members 70 secured as by welding to opposite upper sides of the hull and a lower set of forwardly projecting structural members 72 similarly secured as by welding to lower sides of the hull. Each of the sets of structural members 70 and 72 are provided with cylindrical clamp means 34 comprising an integral semi-cylindrical clamp portion 74 facing forwardly and a pivotally mounted semi-cylindrical clamp portion 76 pivoted about an axis 78 at one side of the clamp means and provided by suitable sets of pivot plates 80 and 82 interleaved as shown in FIG. 3. Hinge or pivot plates 80 are secured to the structural members 72 and pivot plates 82 are secured to semi-cylindrical portion 76. The inner diameter of the cooperative semi-cylindrical portions 74 and 76 may be slightly less than the outer diameter of the outer cylinder 40 so that when the outer clamping portion 76 is secured by means of suitable locking assemblies 84, the clamping portions may tightly frictionally embrace cylindrical member 40 to hold it in readily releaseable yet non-relatively movable relation with the vessel.

Figure 4:
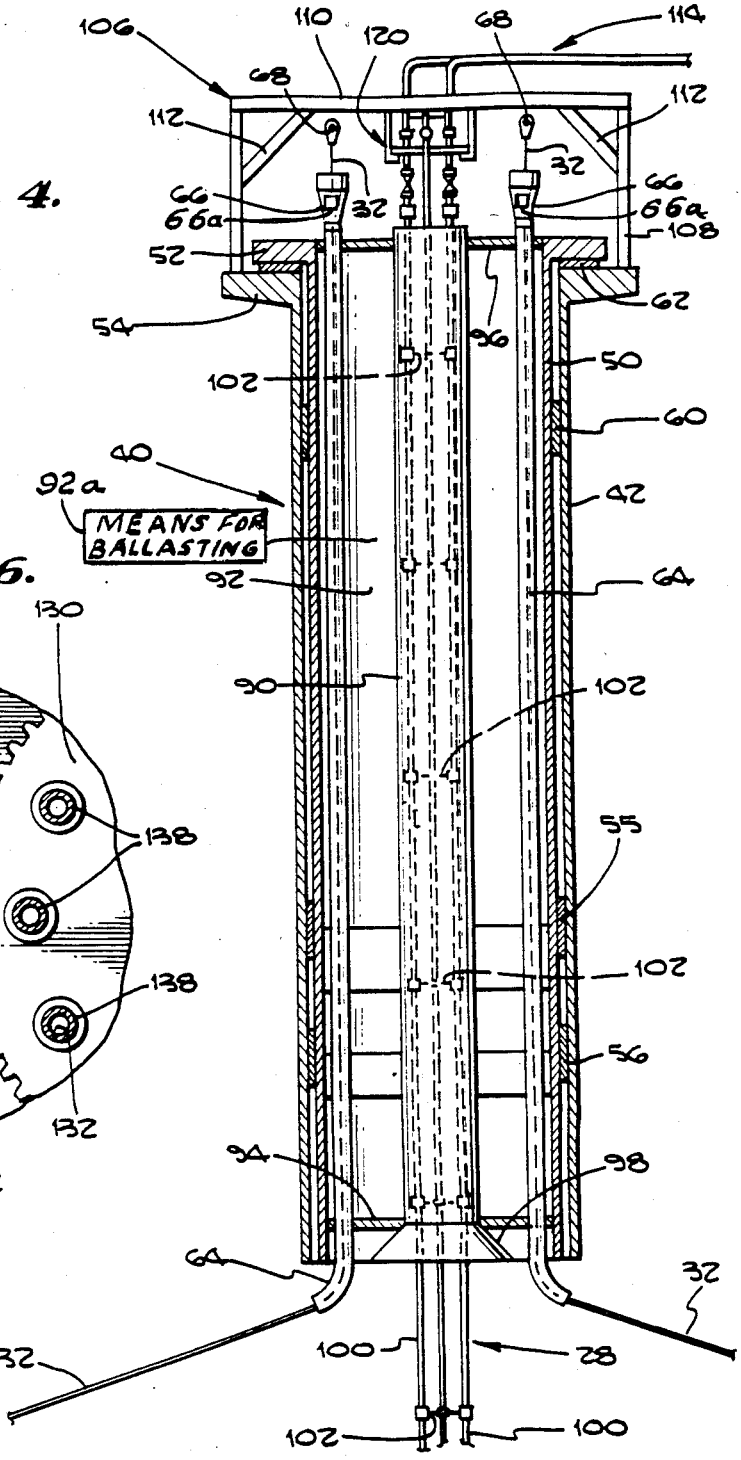
FIG. 4 is a vertical partial sectional view of the spar buoy apparatus, the connection to the vessel bow being omitted.
Figure 6:
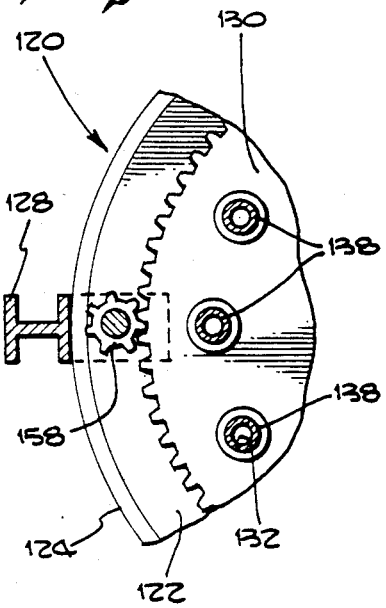
FIG. 6 is a fragmentary horizontal transverse sectional view taken in the plane indicated by line VI—VI of FIG. 5.

Spar buoy means 40 also includes a central coaxial column shaft 90, FIG. 4, which forms with inner cylinder 50 an elongated annular space 92 which may serve as a ballast chamber. Space 92 is closed at its lower end by a bottom wall 94 and at its top end by a top wall 96. Annular space 92 may be ballasted with water, means 92*a* for introducing and releasing ballast material from said space 92 being schematically shown because such are well known in the art. Portions of space 92 may include pressure air chambers to provide positive buoyancy. Foam materials may also be contained in space 92.

Column shaft 90 provides a central passageway for the riser system 28 to enter the lower portion of the spar buoy through an outwardly flared bottom opening 98. Riser system 28 may include a plurality of flexible lines or hoses 100, only three hoses being shown for illustration purposes. Hoses 100 may be held in spaced relation by suitable spacer means 102 provided at spaced intervals along the length of the riser system including that portion extending upwardly into column shaft 90, and the portion extending downwardly below the bottom of the spar buoy means. In very deep water, the lower portion of riser system 28 may include a bottom section of steel riser pipes. The flexible lines 100 may be of relatively small diameter and each line 100 serves as a separate individual conduit for a selected fluid from a subsea well. The term "flexible" includes riser lines made partially of flexible hose and partially of metal pipe.

Figure 5:
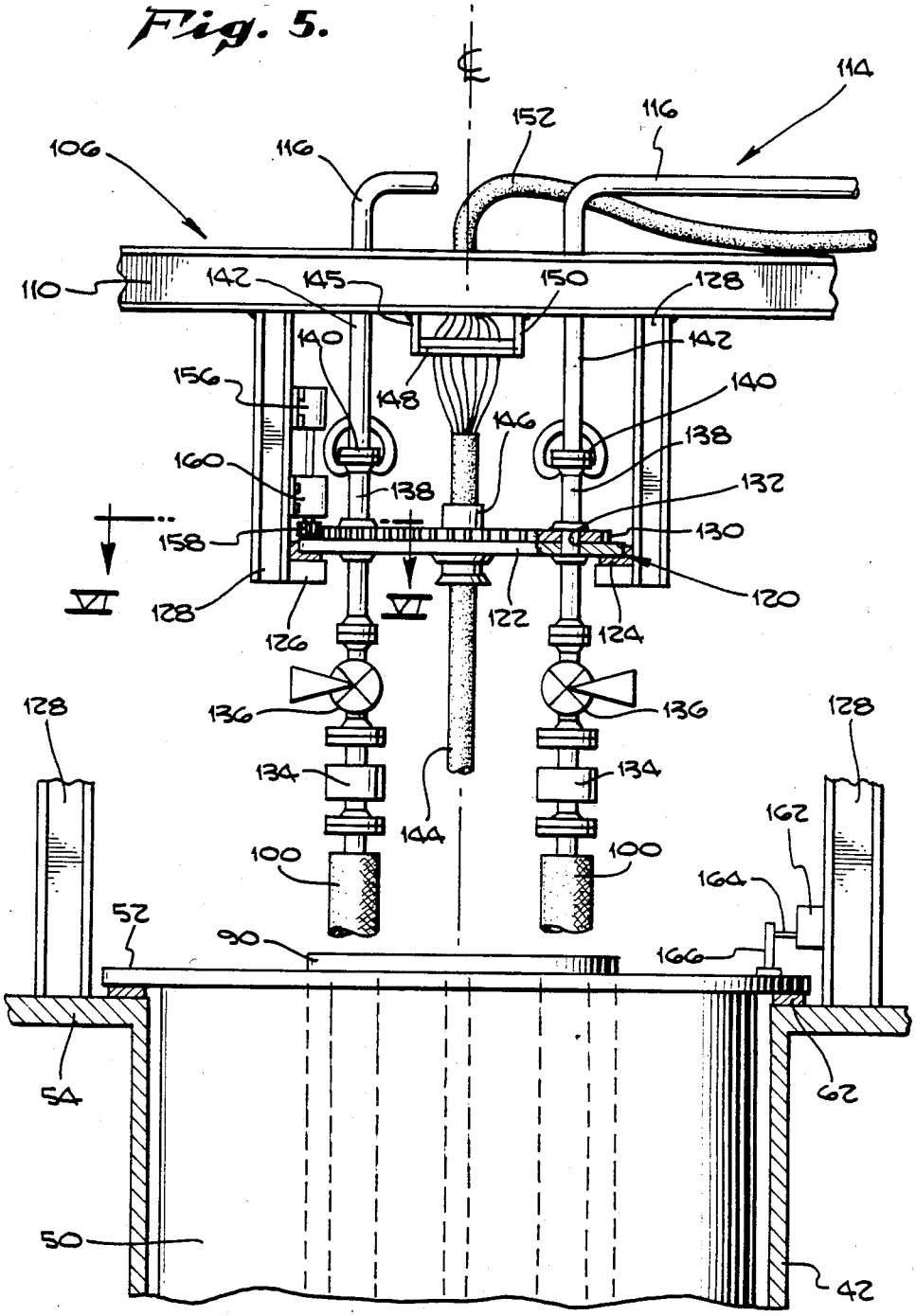
FIG. 5 is an enlarged fragmentary view of the top of the spar buoy apparatus showing the fluid transfer means in greater detail.

A superstructure means to facilitate transfer of well fluids from hose lines 100 of the riser system 28 is best shown in FIGS. 4 and 5 and is generally indicated at 106. Superstructure means 106 includes a structural framework including vertical frame members 108 supported at 110 on outer cylindrical member 42 and its out-turned flange 54 and top horizontal frame members 110 arranged in a selected manner and carried by vertical members 108 and diagonal members 112.

Superstructure means 106 provides support for fluid transfer means generally indicated at 114, which convey production fluids to selected facilities on the vessel.

Fluid transfer means 114 may include suitable pipe transfer lines 116, FIG. 3, suitably supported from the vessel 48 by pipe support members 118 and extending to and over the center of the superstructure means 106.

Means for connecting the fluid transfer lines 116 to the flexible hoses 100 of riser system 28 includes a lockable and unlockable turntable means 120, FIG. 5. Turntable means 120 includes a rotatable circular horizontally disposed plate 122 supported on suitable bearing means 124 which are carried on inturned frame portions 126 provided at the lower end of depending frame members 128 carried by top frame members 110 of the superstructure means. Turntable 122 supports on its upper surface an externally toothed ring gear 130. Fixed in openings 132 in the turntable 122 and ring gear 130 are extensions of each riser line 100. Between turntable 122 and the upper end of shaft 90 each hose line 100 may be connected to a hose swivel means 134, a block valve 136, and a pipe spool means 138 which extends through the openings 132 to above the turntable 120. Each spool means 138 may be connected to a quick disconnect or release flange means 140 which is connected to the end of downturned portion 142 of a transfer line 116.

As shown in FIG. 5, control cables 144 may pass through a fitting 146 provided in turntable means 120 and terminate in a quick disconnect means 148 supported from a frame portion 150 carried by structural frame member 110. The quick disconnect means 148 connects the control cable assembly 144 to a transfer control line 152 connected with the vessel.

Turntable means 120 may be rotatably driven by a motor 156 carried by frame member 128. Motor 156 drives a pinion gear 158 for engagement with the external ring gear 130 for selected turning of the turntable 122. The turntable 122 may be locked relative to the superstructure means by a suitable brake-lock mechanism 160 connected between motor 156 and pinion gear 158.

Means for counting the number of turns made by outer cylinder 42 relative to the normally stationary inner cylinder 50 may include a counting means 162 carried by a frame structural member 128, counting means 162 having a projecting finger 164 adapted to be contacted by an upstanding finger or pin 166 secured to the top of flange 52 on inner cylinder 50. Thus, for each complete turn of outer cylinder 42 and vessel 24 relative to inner cylinder 50 a count will be made thereof. By providing additional pins 166 on the flange 52, the counting mechanism may also indicate fractions of a turn. The pin 166 and finger 164 serve as a reference point for measuring turns or part turns of the vessel.

In operation of the spar buoy apparatus described above, the apparatus may be suitable ballasted to maintain the axis of the spar buoy means in a vertical position. The ballast chamber also provides a means for providing buoyancy to the spar buoy means so that prior to its connection to a bow of a vessel, a spar buoy means may be placed in a vertical floating position in the water and at a selected height so that the spar buoy apparatus may be selectively positioned with respect to the clamp means 34 on the bow of the vessel. When the clamp means 34 are open the apparatus may be readily fitted within the semicircular fixed portion 74 of the clamp means and then secured quickly by moving the hinged portion 76 of the clamp means into closed and locked position. In such attachment operation it may be desirable to vary the ballast of the vessel so that the spar buoy means will be precisely fitted in vertical relation to the vessel.

The spar buoy apparatus may be similarly quickly disconnected from the vessel by first properly ballasting the spar buoy apparatus and then releasing the clamp means 34 so that the spar buoy means may separately float in vertical position in the water.

Figure 2:
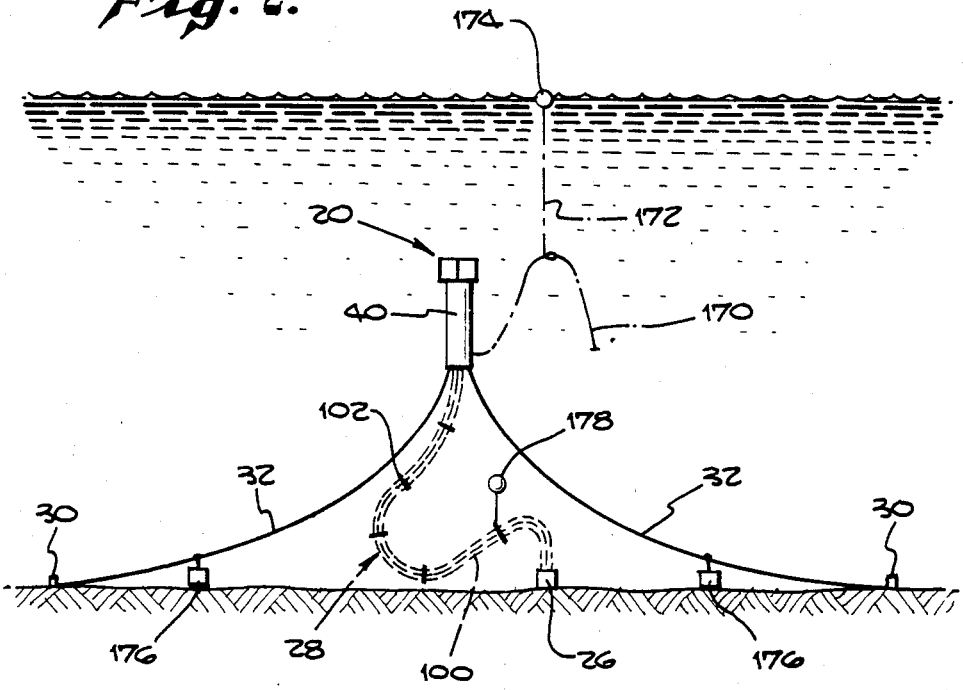

In the event of environmental conditions such as ice floes, it may be desirable to submerge the spar buoy means to a selected depth. Such submergence may be readily accomplished by ballasting the spar buoy means so that it will sink to a selected depth in the water. Under such condition as shown in FIG. 2 the submerged spar buoy apparatus may have connected thereto a tether means 170 which may include an air line to facilitate deballasting of the spar buoy means when it is desired to raise the spar buoy means from submerged position. As shown tether means 170 includes a line 172 connected to a float or location buoy 174 to indicate the location of the spar buoy apparatus when submerged.

Another means for submerging the spar buoy apparatus includes the use of one or more weights 176 on each of the mooring lines 32. Such weights will pull down the mooring lines 32 and the spar buoy apparatus until the weights 176 are resting on the sea floor.

In further operation of the spar buoy apparatus FIG. 1 illustrates the riser system 28 including a plurality of flexible hoses maintained in desired spaced relationship and extending from the subsea well installation 26 to the spar buoy apparatus 20. A buoy 178 may be provided adjacent the subsea installation 26 to maintain the lower portion of the riser system in approximately vertical relation for proper positioning of the lower riser lines with respect to subsea installation 26 and for allowing adequate flexibility for vessel heave. The plurality of flexible hoses 100, maintained in spaced relation by the spacers 102, enter the column shaft 90 in approximately vertical relation, some misalignment thereof being permitted by the outwardly flared opening 98 of the column shaft 90. At the top of shaft 90, the hoses 100 are arranged in a circle by the connections of the pipe spools 138 to turntable means 120.

It will be apparent that when vessel 24 moves about the axis of the spar buoy apparatus, that twisting of flexible lines 100 will occur below the turntable 120. Such turning of vessel 24 is the result of wind and wave conditions and the vessel may weathervane, oscillate or turn one or two times in one direction about the axis of the spar buoy apparatus, the outer cylinder moving with the vessel and the inner cylinder remaining virtually stationary. Flexible riser lines 100 as described above, depending upon the length of the rise lines and depth of water, may be twisted and may tolerate at least two turns of the vessel about the buoy axis when the turntable means 120 is in locked relation with respect to the superstructure means.

Untwisting of the flexible riser lines 100 below the spar buoy apparatus may be readily accomplished without movement of the vessel by unlocking turntable means 120 at the brake and lock means 160 and initially permitting the torque forces of the twisted riser lines to begin the untwisting of the lines. Where such torque forces are not sufficient to cause untwisting of the lines and complete rapid untwisting is required, the motor 156 may be used to drive the turntable 122 in a direction reverse to that of the twist until the number of turns indicator 162 shows that the twisted lines 100 have been fully untwisted.

It will be understood that the vessel may be turned about the axis of the spar buoy apparatus by tug boats or other means to untwist the hose lines 100.

When the turntable means is in unlocked condition, it will be readily apparent that the vessel 24 may freely weathervane about the axis of the spar buoy apparatus.

In the event the spar buoy apparatus is required to be disconnected from the vessel because of an approaching storm or other environmental condition, it will be readily apparent that the turntable means 120 may be placed in unlocked condition and the quick disconnect flange means 140 for each of the flexible riser lines 100 may be quickly disconnected to release lines 100 from transfer lines 116. The quick disconnect means 148 for the control means 144 may similarly released from transfer control line 152. Upon such complete disconnection the clamp means 34 holding the spar buoy means 20 to the vessel 24 may be released and the spar buoy means permitted to float free in the water.

From the above description it will be apparent that a novel method of transferring fluids from a plurality of subsea wells to a vessel adapted to weathervane about a single point spar buoy mooring apparatus includes maintaining continuity of each production fluid through separate individual riser lines to transfer lines while the vessel turns about the axis of the spar buoy mooring apparatus. Such method of transferring fluids under such condition includes connecting the upper ends of the fluid riser lines to the turntable while the turntable remains locked against rotation relative to the superstructure and vessel. The number of turns of the vessel about the axis of the spar buoy apparatus is counted and when a maximum or selected number of turns has been counted, the turntable may be unlocked and the twist in the flexible riser lines may be untwisted by rotating the turntable in a reverse direction to cause untwisting of the riser lines. During this operation, the flow of production fluids through each riser line and transfer line is interrupted and production operations may continue after such untwisting of the riser lines.

This method of transferring fluids also facilitates discontinuance of the transfer of production fluids to the vessel in the event environmental conditions or other conditions require free weathervaning of the vessel about its moored axis or separation of the spar buoy apparatus from the vessel. Quick disconnect means 140 permits separation of the riser lines from its associated transfer line 116 so that in unlocked turntable condition the vessel may freely weathervane about the axis of the spar buoy apparatus for unlimited turns.

The advantages of the above described spar buoy apparatus are readily apparent to those skilled in the art. The twisting like a "barber's pole" of the flexible riser lines between the turntable and sea floor as the vessel weathervanes eliminates the requirement of subsea manifolds or multiple passage fluid swivels as commonly used in tanker moorings. The present system utilizing a lockable and unlockable turntable and quick disconnect means between riser lines and transfer lines provides return of the riser lines to an untwisted configuration without moving the vessel. In addition, each of a plurality of subsea wells may be independently produced, tested or treated during rotation of the vessel about the axis of the spar buoy apparatus.

When desired, the vessel may be detached from the spar buoy apparatus and moved to another location while the spar buoy apparatus remains at the subsea site and supports the mooring and flexible riser lines.

It is also considered that installation of the spar buoy apparatus may be located at either the bow, stern, or intermediate sections of the vessel.

The term subsea wells or subsea installations contemplates and includes any subsea floorline from any onshore or offshore installation.

It will be understood that various modifications and changes may be made in the exemplary embodiment of this invention described above and which come within the spirit of this invention and all such changes and modifications coming within the scope of the appended claims are embraced thereby.

I claim:

1. In a single spar buoy mooring apparatus having an axis and including an outer rotatable cylinder which supports a superstructure attachable to a vessel, and inner nonrotatable cylinder within the outer cylinder and connected by mooring lines to the sea floor, a riser system including multiple riser lines extending from a subsea installation to the top of said cylinders, and transfer lines extending from the superstructure to the vessel, the provision of:

means for connecting each riser line to an associated transfer line, said connecting means including a turntable means carried by said superstructure and connected with each riser line;

and means for locking said turntable means against rotation relative to said superstructure whereby turning of the vessel about the axis of the spar buoy apparatus under locked condition imparts twist to said multiple riser lines;

said locking means being unlockable to allow said turntable means to return to a position where said riser system is untwisted.

2. An apparatus as claimed in claim 1 including motor means on said superstructure for turning said turntable means in unlocked condition to facilitate untwisting of said riser lines.

3. An apparatus as claimed in claim 1 including counting means for indicating the number of turns made by said vessel about the axis of said apparatus.

4. An apparatus as claimed in claim 1 including quick disconnect means at the connection of each riser line with its associated transfer line.

5. An apparatus as claimed in claim 1 including control lines for said subsea installation passing through the center of said turntable means;

transfer control lines on said superstructure;

and quick disconnect means between said subsea control lines and said associated transfer control lines.

6. An apparatus as claimed in claim 1 including swivel means and block valve means in each riser line below said turntable means.

7. In a single point spar buoy apparatus adapted to be removably attached to a vessel and for transferring fluids from one or more subsea wells to the vessel while maintaining the fluid from each well separate and independent of the other well fluids, the combination of:

a spar buoy means vertically positionable in the water and comprising an outer cylindrical means fixed to said vessel bow for movement therewith under wind, wave and current conditions;

a superstructure means carried by the outer cylindrical means and including a plurality of fluid transfer means connected with the vessel;

an inner cylindrical means supported by and within said outer cylindrical means;

means between the outer and inner cylindrical means for rotation of the outer cylindrical means relative to the inner cylindrical means;

mooring means connecting the inner cylindrical means with the sea floor and holding the inner cylindrical means against rotation while the outer cylindrical means and vessel moves in response to said wind, wave and current conditions;

a plurality of flexible fluid carrying line extending from said subsea wells through said inner cylindrical means;

and means for connecting each of said fluid carrying lines to one of said fluid transfer means, said connecting means including;

a turntable rotatably supported from said superstructure means and through which said flexible fluid lines pass;

and means for releasably holding in nonrotatable condition said turntable relative to said superstructure whereby turning of the vessel about said spar buoy means causes twisting of said flexible fluid lines while maintaining fluid communication through each of said flexible lines and each associated transfer means, said holding means being releasable to allow rotation of said turntable for untwisting of said flexible lines after being twisted and for free rotation of said vessel about said spar buoy means.

8. An apparatus as claimed in claim 7 including quick disconnect means for each of said fluid lines adjacent said superstructure means.

9. An apparatus as claimed in claim 7 including means for rotating said turntable when said holding means is in released condition.

10. An apparatus as claimed in claim 7 including means within said inner cylindrical means for ballasting and deballasting said spar buoy means.

11. An apparatus as claimed in claim 7 including means on said inner cylindrical means and on said outer cylindrical means for counting the number of turns made by said outer cylindrical means relative to the inner cylindrical means.

12. A method of transferring fluids from a plurality of subsea wells to a vessel having a single point spar buoy mooring apparatus fixed to its bow end, said apparatus having an outer cylinder, an inner concentric cylinder rotatable relative to said vessel and outer cylinder, said outer cylinder and vessel being adapted to turn about the axis of said spar buoy apparatus, said apparatus having flexible fluid riser lines extending through the inner cylinder and to the sea floor, and fluid transfer lines carried by a superstructure supported from said outer cylinder and connected to said riser lines adjacent a turntable rotatably carried on said superstructure; including the steps of:

connecting the upper ends of said fluid riser lines to said turntable;

locking said turntable against rotation relative to said superstructure whereby said riser lines may twist during weathervaning of said vessel;

counting the number of turns of said outer cylinder and vessel relative to the inner cylinder during such weathervaning of the vessel;

unlocking said turntable;

and untwisting said twisted flexible riser lines by reverse turning of said turntable.

13. A method as claimed in claim 12 including the step of maintaining the connection between each riser line and its associated fluid transfer line during said twisting and untwisting of said riser lines.

14. A method as claimed in claim 12 wherein each riser line includes quick disconnect means to said transfer lines, the additional step of:

opening each quick disconnect means for free weathervaning of said vessel about said apparatus.

* * * * *